United States Patent [19]

Ziaylek, Jr.

[11] Patent Number: 4,586,687

[45] Date of Patent: May 6, 1986

[54] AIR TANK SUPPORT OF THE QUICK RELEASE TYPE

[76] Inventor: Theodore Ziaylek, Jr., 140 Riverview Dr., Yardley, Pa. 19067

[21] Appl. No.: 705,282

[22] Filed: Feb. 25, 1985

[51] Int. Cl.[4] ..... A47F 5/00

[52] U.S. Cl. ..... 248/313; 248/316.5; 169/51; 224/148; 211/75

[58] Field of Search ..... 248/313, 316.2, 154, 248/316.5; 169/51; 224/148; 211/71, 75, 88

[56] References Cited

U.S. PATENT DOCUMENTS

| | | | |
|---|---|---|---|
| 2,109,821 | 3/1938 | Dunica | 248/313 |
| 3,194,529 | 7/1965 | Brock | 248/313 |
| 3,547,391 | 12/1970 | Johnson | 248/311 |
| 3,603,550 | 9/1971 | Byrd | 248/313 |
| 3,737,133 | 6/1973 | Boecker | 248/313 |
| 3,780,972 | 12/1973 | Brodersen | 248/313 |
| 3,823,907 | 7/1974 | Ziaylek, Jr. | 248/313 |
| 3,921,950 | 11/1975 | Sentinella | 248/313 |
| 4,304,383 | 12/1981 | Huston | 248/313 |

FOREIGN PATENT DOCUMENTS

| | | | |
|---|---|---|---|
| 380320 | 7/1907 | France | 248/99 |

*Primary Examiner*—Robert W. Gibson, Jr.
*Assistant Examiner*—Blair M. Johnson
*Attorney, Agent, or Firm*—Sperry, Zoda & Kane

[57] ABSTRACT

A support for an air tank of the type used in breathing apparatus has an improved means for releasably gripping the tank. It uses, for this purpose, crank elements rotatable with parallel bars to which are secured arms that clamp the tank between them. The crank elements overlap in a space between the bars, and their overlapping areas are slidably and pivotally interengaged. Swinging movement of one of the elements produces corresponding swinging movement of the other to rotate the bars between opposite extreme positions in one of which the clamp arms grip, and in the other release, the tank or cylinder. A user releases the cylinder by throw of a conveniently disposed handle. The handle rotates a cam in contact with a cam follower in the form of an angular arm rigid with one of the crank elements, to translate rotation of the cam through approximately 90° into a swinging movement of the articulated linkage defined by the crank elements, over a dead center. The clamp arm support bars are in this way jointly rotated in opposite directions to swing the clamp arms outwardly. The cylinder is thus released. The throw of the handle in the opposite direction produces a reverse movement of all of the parts, causing clamping engagement of the supported cylinder.

10 Claims, 5 Drawing Figures

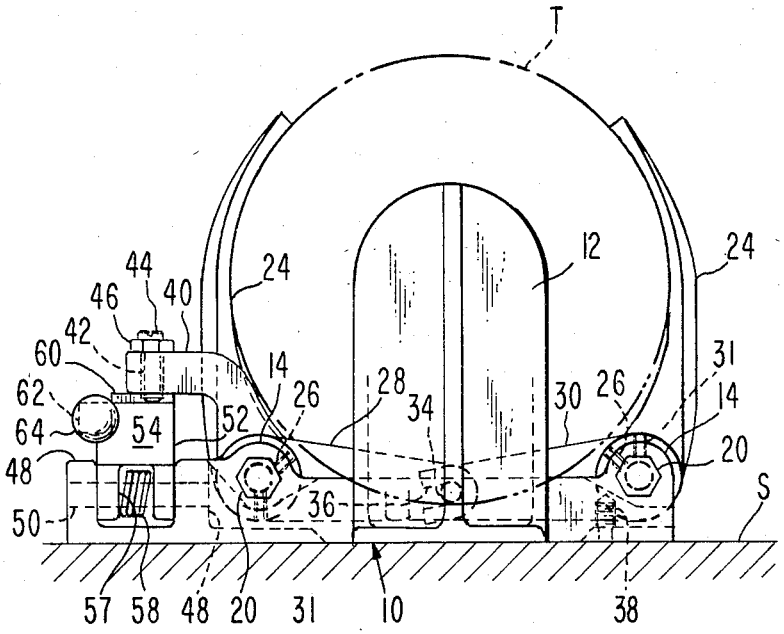
Fig. 3.
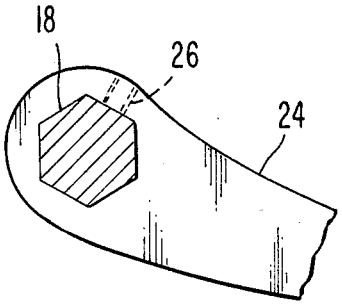
Fig. 5.
Fig. 4.
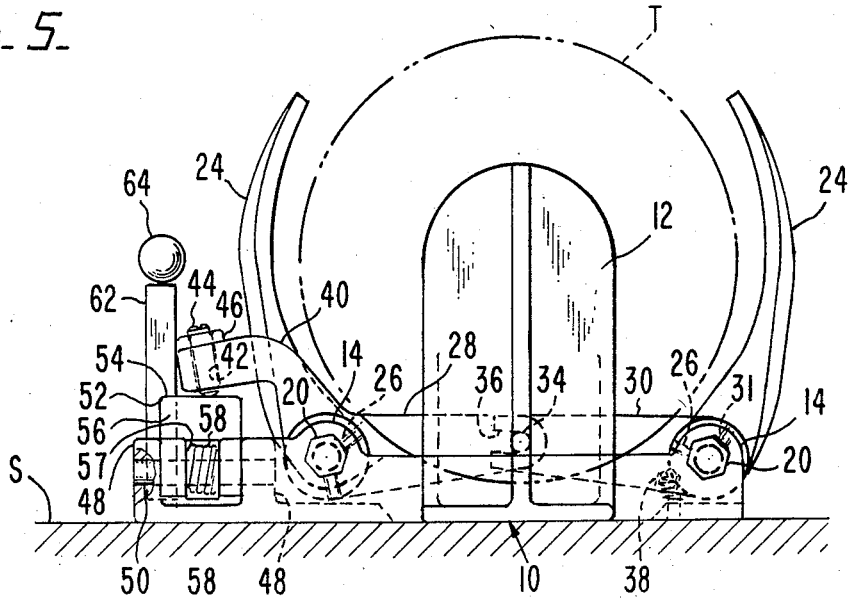

AIR TANK SUPPORT OF THE QUICK RELEASE TYPE

BACKGROUND OF THE INVENTION

1. Field of the Invention

The present invention relates generally to supports or holders, and in a more particular sense, refers to a device of this type adapted to clampably engage an air tank or cylinder of the type that is carried on the back of a firefighter or a rescue squad member.

Devices of this type are in widespread use today, in firefighting and rescue operations, and normally are supported in vertical positions against the walls of firehouses or kept in containers stored in truck compartments or the quarters of rescue squads, or alternatively they may be found mounted upon firetrucks or rescue vehicles, on the backs of jump seats provided upon said vehicles, or indeed in any location where it is desirable or important to provide swift and convenient access to a cylinder of the type described.

Thus, in a more specific sense, the invention relates to supports for air tank cylinders of the type adapted to be carried upon one's back as part of breathing apparatus, and in particular the present invention relates to devices of this nature so designed as to permit swift and easy release of the cylinder so that the wearer can walk away with the cylinder strapped to his back as part of a breathing apparatus.

2. Description of the Prior Art

Heretofore, it has been proposed to provide devices of the type generally described above, and such devices have included means for quickly releasing a tank or cylinder from a clamping engagement by arms movably mounted upon a backplate or equivalent support.

To this end, it has been heretofore proposed to provide vertically spaced pairs of clamp arms, mounted upon rotatable bars, said clamp arms being adapted to normally grip an oxygen tank or cylinder. In association with the clamp arms, it has also been proposed to provide means including a handle adapted to be grasped by the user, for the purpose of swinging the tank-engaging arms to outwardly swung release positions. In this way, the tank is freed, and the wearer is enabled to walk away with the tank strapped to his back.

The prior art, however, has generally required mechanisms that are relatively complex, or in some instances are not adapted to be operated with a wholly desirable speed and ease. It has been proposed, for example, to provide a device of this type in which the arms are controlled by pivoted dogs, normally maintained in spaced relation by a plunger capable of being withdrawn responsive to throw of the handle by the wearer.

It has been the main object of the present invention, accordingly, to provide a device of the nature described above, that will be adapted to swing the tank-engaging arms between clamping and release positions with a minimum of movement of the associated components of the mechanism controlled by the wearer for the purpose of swinging the clamp arms in this way.

A more specific object is to provide a device of the type stated which will be sure in operation, will require a minimum amount of force by the user to throw the handle between its opposite extreme positions, and will be capable of trouble free operation over a long period of time.

Still another object of importance is to overcome the prior art deficiencies by incorporating in the invention a capability of swiftly and easily adjusting the movable components of the operating mechanism, in such a manner as to permit the device to be adjusted for cylinders of specifically different diameters, and also to permit the tightness of the clamping engagement to be adjusted, in a highly precise fashion.

SUMMARY OF THE INVENTION

Summarized briefly, the present invention includes a backplate adapted to be mounted upon any suitable supporting surface, in a vertical position. Rotatably mounted upon the backplate are transversely spaced, vertically disposed clamp arm support bars. Secured to the bars, for vertical adjustment along the length of the bars, are pairs of clamp arms, adapted to be swung between first positions in which they securely and tightly engage about a supported oxygen tank or cylinder, and a second position in which they are thrown outwardly to release the cylinder and permit it to be removed bodily from the support.

For the purpose of swinging the clamp arms between their respective extreme positions, the present invention encompasses the provision of an articulated linkage, in the form of a pair of cranks or radial operating arms that extend toward each other, across the space between the bars. The cranks overlap midway between the bars, and are there slidably and pivotally connected, so that a swinging movement or throw of one of the cranks imparts corresponding, simultaneous swinging movement of the other one.

For the purpose of operating the cranks between their opposite extreme positions, there is provided a means under the control of a user, in the form of a handle to which there is integrally or otherwise rigidly connected a cam element rotatably mounted upon the backplate. The cam element has a cam surface which is eccentrically disposed relative to the axis of the rotation of the cam. In slidable contact with the cam surface is an adjustable pin provided upon the distal end of a cam follower arm formed as an extension of one of the cranks.

Throw of the handle between opposite extreme positions rotates the cam, causing biasing of the cam follower, which in turn swings one of the cranks or crank elements, and thereby causes the other crank element to be correspondingly, swingably moved. In this way, the bars are rotated in opposite directions, to swing the clamp arms between clamping or release positions, according to the direction in which the user operates the handle of the device.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 3 is a bottom plan view of the device, as viewed from line 3—3 of FIG. 2, the supported tank being shown in dotted lines, the several components being shown in the positions assumed thereby when the tank is being retained by the clamping arms;

FIG. 4 is a view similar to FIG. 3, in which the several components are shown in the tank-releasing positions thereof; and FIG. 5 is a fragmentary, detail sectional view substantially on line 5—5 of FIG. 1.

DESCRIPTION OF THE PREFERRED EMBODIMENT

Figure 1:
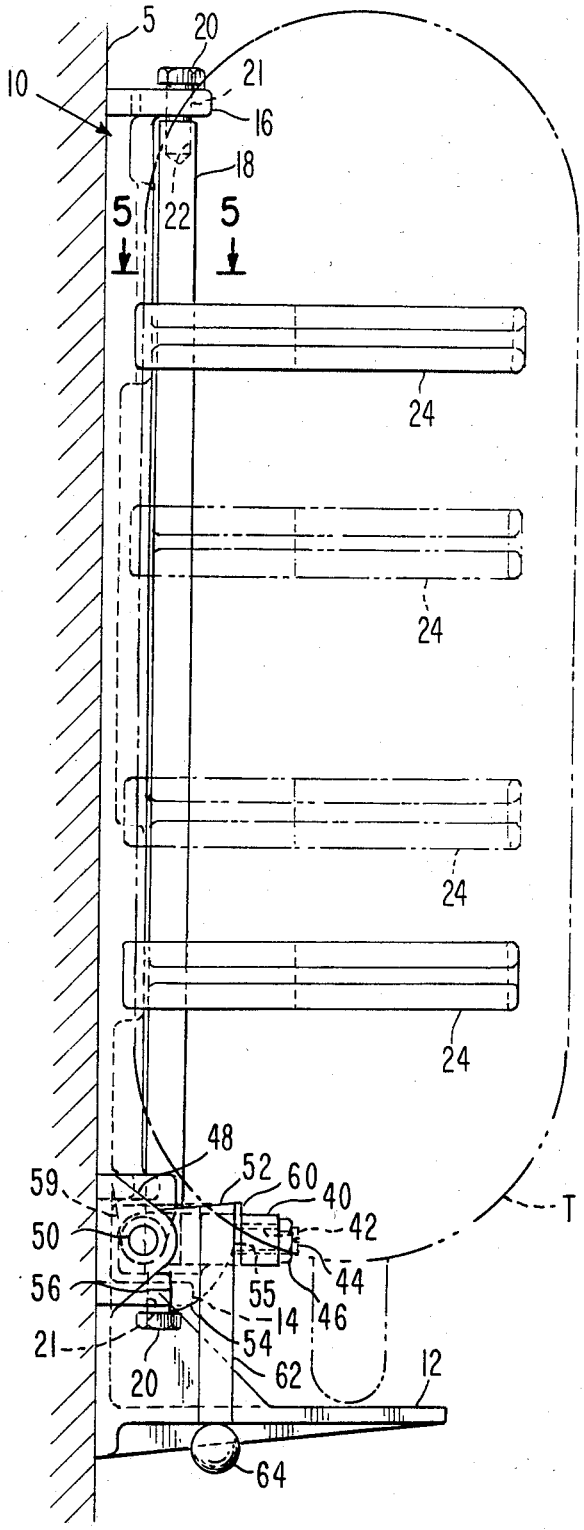
FIG. 1 is a side elevational view showing a support for air tank or cylinders, constructed according to the present invention, as it appears when in operative, clamping engagement with an air tank or cylinder, the tank being shown in dotted outline, the clamp arms being shown in adjusted positions in dotted lines.

Referring to the drawing in detail, the reference character S designates a wall or other supporting surface upon which the device can be mounted. The reference character T designates a conventional air tank or cylinder that is to be supported against said wall, awaiting use.

The device comprising the present invention includes a backplate generally designated 10, which may take various forms, but which is primarily characterized in that it is a basically flat, vertically elongated plate member connectable fixedly to the wall or other supporting surface S in any suitable manner not comprising part of the present invention.

The backplate 10, at its lower end, is integrally formed with a forwardly, horizontally projecting shelf or ledge, providing a support for the lower end of a tank T disposed in vertical position against the backplate.

Integrally provided upon the lower end portion of the backplate are transversely spaced, forwardly projecting lower bearings 14, disposed, respectively, in vertical alignment with correspondingly formed upper bearings 16 provided at the upper end of the backplate (see FIG. 1).

Extending between the upper and lower bearings are transversely spaced, parallel, vertically disposed clamp arm support bars 18, said bars being closely spaced in relation to the backplate, adjacent the opposite side edges of the backplate. Bars 18 are adapted to be rotatably mounted, to rotate in opposite directions, and for this purpose there are provided trunnions in the form of screws 20 having smooth-walled portions rotatably engaged in openings 21 provided in the respective bearings. The screws 20 are threadedly engaged in axial recesses 22 extended inwardly from the opposite ends of each of the bars 18.

In this way, ease of assembly of the bars with the backplate is provided, in that the bars can simply be disposed between their associated upper and lower bearings, after which the screws 20 can be extended through the bearing openings and threadedly engaged in the recesses 22. Disassembly of the device is achieved with equal ease, for the purposes of maintenance, or for the purpose of substituting other sets of bars and clamp arms designed to accommodate tanks of diameters or configurations different from that shown by way of example in the drawing.

Provided upon each of the bars are vertically spaced clamp arms 24. In the illustrated example, there are two pairs of clamp arms, although the number can of course be varied as desired. The clamp arms are attached to the respective bars by set screws 26 (see FIG. 5). It may be noted, in this regard, that the bars 18, in the illustrated example, are of hexagonal cross section, and accordingly, the several clamp arms have proximal ends formed with correspondingly hexagonal bar-receiving openings. Set screws are then threaded through the proximal ends of the arms 24 into engagement with bar 18, thus securing the arms in selected positions of vertical adjustment along the length of the bars associated therewith.

Rotation of the bars in one direction will thus cause the clamp arms to be swung inwardly, to tank-engaging positions shown in FIG. 3. When the bars are rocked or rotated in the opposite direction, the clamp arms are swung outwardly to the tank-releasing positions thereof shown in FIG. 4.

The swift removal of the bars, as will be understood, also permits different sets of clamp arms to be substituted on the same bars. In other words, as indicated above, one can substitute completely different bars and clamp arms, or alternatively, one can retain the same bars and simply substitute different clamp arms, both of these procedures being facilitated by the capability of the bars.

The clamp arms project forwardly, along curving paths, from the bars, as shown to best advantage in FIGS. 3 and 4.

In accordance with the present invention, an improved means is provided for operating the clamp arms between their tank-gripping and tank-releasing positions. To this end, there are provided, at the lower end of the backplate, crank elements 28,30, said elements being in the form of arms extending radially from the respective bars for the purpose of rotating the bars responsive to throw or swinging movement of the respective crank elements. The crank elements take the form of a toggle joint, in that the elements have proximal ends that are fixedly secured to the respective bars, with said crank elements then extending inwardly across the space between the bars, to positions in which their distal ends overlap midway between the bars 18. The crank elements are rigidly secured to the bars for rotation therewith, through the provision of set screws 31, again for the purpose of facilitating the swift attachment or detachment of the bars, and also for the purpose of facilitating the initial assembly of the device comprising the invention.

Figure 2:
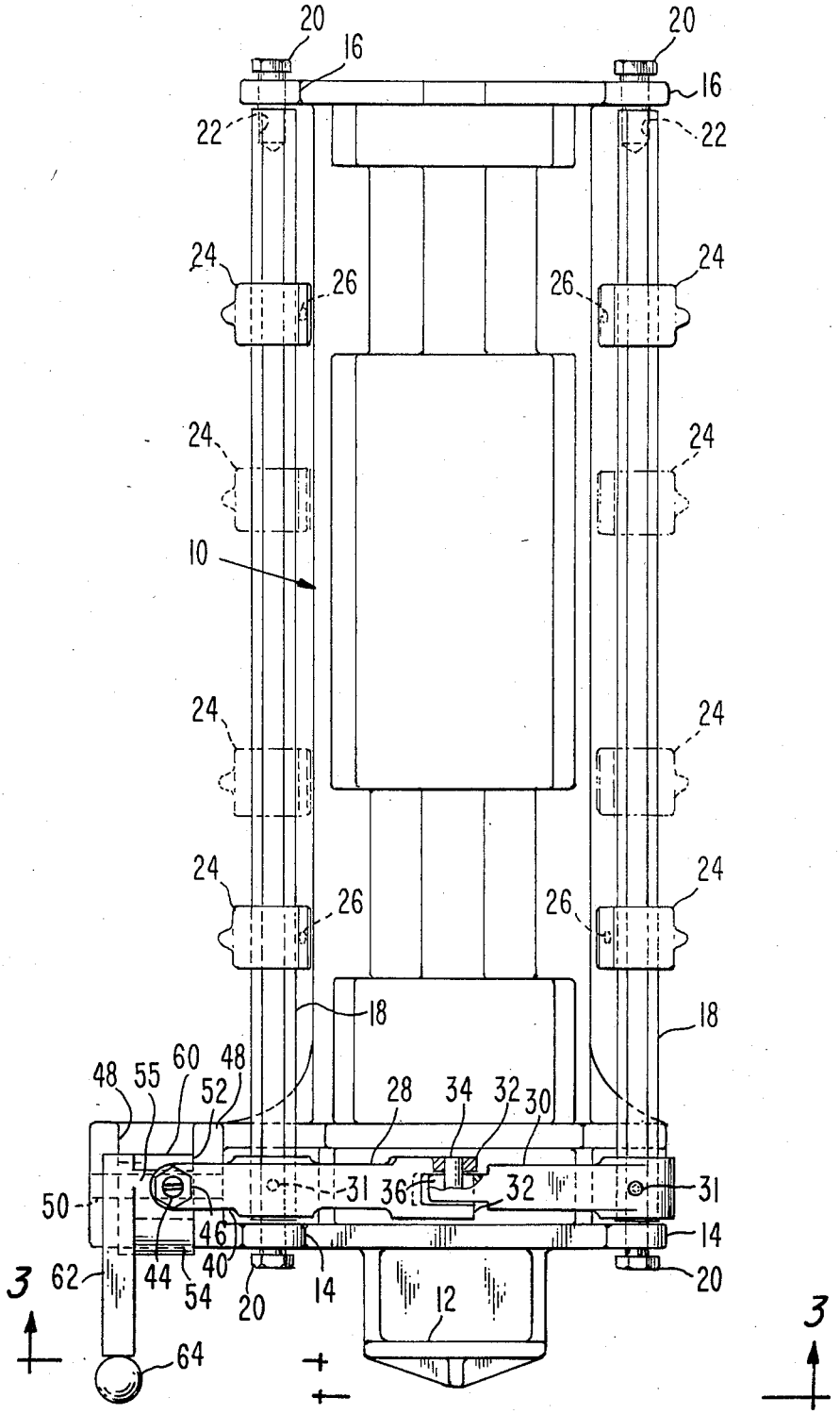
FIG. 2 is a front elevational view of the device comprising the present invention, the several components being shown in position for clampably engaging an oxygen tank, the dotted lines showing adjusted positions of the clamp arms.

Referring to FIG. 2, the distal end of the crank element 28 is formed with arms 32, between which extends a connecting pin 34, so that the crank element 28 in effect is provided with a clevis at its distal end, disposed in embracing relation to the distal end of crank element 30. Element 30 is formed, at its distal end, with a slot 36, receiving pin 34 so that the elements 28,30 are slidably, pivotally connected at their distal ends to produce an articulated linkage that extends between the bars, and that is effective to rotate the bars simultaneously in opposite directions, between first positions in which the clamp arms 24 are in clamping engagement with the tank T, and second positions in which the clamp arms are swung outwardly to their FIG. 4 positions for the purpose of releasing the tank.

Normally biasing the crank elements to their FIG. 4, release positions is a compression, coil spring 38 interposed between element 30 and the backplate. The spring can be otherwise located, or otherwise formed, and indeed, springs can be provided for both crank elements, for the purpose of biasing the crank elements to their FIG. 4 positions. It is possible, also, to provide a spring or springs in association with the bars 18, for the purpose of rotating the bars to positions in which the clamp arms will release the supported tank T. It is mainly important, to assure maximum ease and sureness of operation of the device, that the spring means be located in association with one or more of the movable components, and tensioned to normally bias the clamp arms to the tank-releasing position whenever they are freed to do so.

Crank element 28 is, as will be noted from FIG. 4, one end portion of a bell crank lever, which also includes an extension arm 40 of approximately L shaped configuration, said extension arm 40 being integral with the crank element 28 and extending radially from the bar 18 to which the crank element 28 is secured, in angularly spaced relation to the crank element 28. The extension arm 40 has a distal end formed with a threaded opening 42, receiving a cam follower pin 44 in the form of a threaded stud, which is adapted to be adjusted in an axial direction to selected positions, and thereafter locked in the selected position of adjustment through the provision of a lock nut 46 bearing against the extension arm 40. Arm 40, and pin 44 and its lock nut 46 together comprise a cam follower means adapted to engage a cam means the position of which is controlled by a user of the device.

The cam means is rotatably mounted upon the backplate. To this end, there are integrally provided upon the backplate, at the lower end thereof, in laterally outwardly spaced relation to one of the bars 18 (see FIG. 2), a pair of forwardly projecting bearings 48 having bearing openings in which there is journaled a cam support pin 50 on which is rotatably mounted a cam element 52. Cam element 52 projects forwardly from the bearings 48 (see FIG. 1) and has a cam surface 54 curved eccentrically in respect to the axis of rotation of the cam support pin 50. The distance of the cam surface 54 from the axis of rotation of pin 50 progresses in a direction from the lower end of the cam, viewing the same as in FIG. 1, to the upper end thereof when viewed in the same figure of the drawing. At the upper end, the cam surface merges into a flat 55 against which the cam follower pin bears when the tank is clampably engaged by the arms 24.

At the other end, where the distance of the cam surface 54 from the axis of rotation of pin 50 is at its smallest, the cam surface ends at a shoulder 56 which engages against the backplate to limit the downward swinging movement of the cam element.

The cam element is rotatable through approximately 90°, from the position shown in FIGS. 1 and 2 to the position shown in FIG. 4. In the FIG. 4 position, the cam element is in its position permitting release of the tank T.

Referring again to FIG. 1, formed upon the backplate is a stop surface 59, which engages against the top surface of the cam element, viewing the same as in FIG. 1, when the cam element is swung upwardly to its FIG. 4 position. In this way, the opposite extreme limits of travel of the cam element are defined, with travel of the cam element being limited to approximately 90° of angular travel about the axis of the pin 50.

Referring to FIG. 4, formed in the rear surface of the cam element 52 is a deep recess 57, receiving a torsion spring 58, which extends about the pin 50. Torsion spring 58 has one end bearing against the backplate, and has its other end engaged with the cam element, and the spring is tensioned to normally swing the cam element to the position thereof as shown in FIG. 1 and also in FIG. 2, in which position the clamp arms 24 will be in clamping engagement with the tank T.

Formed upon the block or element 52, immediately adjacent and above the flat 55, is a stop 60, which provides a convenient reference for properly locating the cam follower pin 44 relative to the cam element during assembly of the device. Normally, the cam follower pin (see FIG. 1) will project from the extension arm 40 to the extent of the depth of the stop 60, although of course the cam follower pin can be adjusted to project inwardly to a greater extent, to adjustably position the extension arm 40 in respect to the cam surface and thereby in turn determine the extent of travel or throw of the crank elements 28, 30.

The crank elements, in any event, are so disposed that the center of the pin 34, that is, the axis of their pivotal connection to each other, travels across a dead center, that is, across a straight line drawn between the axis of rotation of the respective bars 18, when the crank elements are thrown or swung between their opposite extreme positions shown in FIGS. 3 and 4 respectively.

For the purpose of rotating the cam element, there is provided a handle 62 that is integral with the cam element, although it can be otherwise fixedly attached thereto if desired. Handle 62, when the arms 24 are in tank-clamping positions, extends downwardly, parallel to the bars 18. At its outer end, handle 62 is provided with a ball 64 to facilitate its being grasped and swung by the user.

When the handle 62 is grasped and pulled forwardly, it swings through 90°, to the FIG. 4 position thereof. In these circumstances, the follower pin 44 travels along the surface 54, being held in slidable contact with said surface by the tendency of spring 38 (FIG. 4) to expand.

As the pin 44 travels along the surface 54 toward the shoulder 56, responsive to the rotational movement of the cam 52 in a counter-clockwise direction viewing the same as FIG. 1, the arms 28, 30 are caused to move from their FIG. 3 positions across a dead center, to their FIG. 4 positions, in which they will be disposed to swing the arms 24 outwardly out of engagement with the tank.

A tank of this type is normally strapped to the back of a wearer, at the time the wearer swings the handle upwardly so that the wearer can now walk away with the tank strapped to his back, as part of the breathing apparatus carried by the wearer.

Whenever a tank is to be re-clamped to the device, it is simply positioned upon the ledge, with the arms 24 initially in their outwardly swung, FIG. 4 positions. Then, the handle is swung downwardly and this will cause the crank elements 28, 30 to travel from their FIG. 4 to their FIG. 3 positions, across a dead center once again, against the force of the spring 38, with the pin 44 once again moving onto the flat 55 to retain the several components of the device in position to cause the clamping action to be effectively maintained upon the Tank T.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. In an air tank support of the quick-release type having a backplate adapted to support an oxygen tank, a pair of spaced parallel bars mounted thereon for rotation between first and second positions, clamp arms secured to the respective bars to rotate therewith between said positions, the arms in one of said positions being disposed to grip between them an air tank supported upon the backplate and being disposed to release the tank in the other position of the bars, the improvement that comprises:

(a) means for rotating the bars between said positions thereof including (1) first and second crank means connected to and adapted to rotate the respective bars, (2) means interengaging the crank means with each other both for joint swinging movement in a first direction effective to rotate the bars to their first positions and in a second, opposite direction in which the bars are rotated in their second position, and (3) means adapted to be controlled by a user for biasing the crank means in said first and second directions thereof, the respective crank means including crank elements having proximal ends fixedly attached to the respective bars and distal ends overlapping in the space between the bars, said means interengaging the crank means comprising a slidable pivotal connection at the distal ends of said crank elements.

2. In a tank support the improvement of claim 1 wherein said pivotal connection has an axis that moves across dead center in respect to a straight line extending between the axes of rotation of the respective bars responsive to biasing of the crank means in said first and second directions thereof.

3. In a tank support the improvement of claim 2 wherein the crank means is spring-urged in one of said directions thereof.

4. In a tank support the improvement of claim 1 wherein said user-controlled means includes cam follower means on one of said crank elements and cam means mounted on the backplate adapted for movement of the follower means angularly about the axis of rotation of the bar to which said one crank element is affixed whereby to jointly rotate said one crank element and its associated bar under the control of a user.

5. In a tank support the improvement of claim 4 wherein the cam means includes a cam element rotatably mounted on the backplate in camming engagement with the follower means, and a handle on the cam element.

6. In a tank support the improvement of claim 5 wherein the handle extends in generally parallel relation to the axes of rotation of the bars in the tank-gripping position of the clamp arms, and projects forwardly approximately normally to said axes when the clamp arms are in their tank-releasing positions.

7. In a tank support the improvement of claim 5 wherein the cam element includes a cam surface curved eccentrically to the axis of rotation of the cam element, said cam follower means bearing against the cam surface and being adapted to follow the same along a path effective to bias said one crank element in at least one of the directions in which it is movable.

8. In a tank support the improvement of claim 7 wherein the cam element includes a stop engageable with the cam follower means to limit travel of the cam element in one direction.

9. In a tank support the improvement of claim 7 wherein the cam element is under spring bias tending to rotate the same in one direction.

10. In a tank support the improvement of claim 7 wherein the cam follower means includes an extension arm integral with said one crank element, and a cam follower pin adjustably mounted on the extension arm in engagement with the cam surface.

* * * * *